US009562374B1

(12) United States Patent
Haber

(10) Patent No.: US 9,562,374 B1
(45) Date of Patent: Feb. 7, 2017

(54) CARGO DOOR SEAL PROTECTOR

(71) Applicant: Greg Haber, Woodbury, NY (US)

(72) Inventor: Greg Haber, Woodbury, NY (US)

( * ) Notice: Subject to any disclaimer, the term of this patent is extended or adjusted under 35 U.S.C. 154(b) by 0 days.

(21) Appl. No.: 15/263,435

(22) Filed: Sep. 13, 2016

Related U.S. Application Data

(60) Provisional application No. 62/356,279, filed on Jun. 29, 2016.

(51) Int. Cl.

| | |
|---|---|
| ***E05B 13/00*** | (2006.01) |
| ***E05B 67/38*** | (2006.01) |
| ***E05B 73/00*** | (2006.01) |
| ***E05B 83/14*** | (2014.01) |

(52) U.S. Cl.
CPC ..... *E05B 73/00* (2013.01); *E05B 67/38* (2013.01); *E05B 83/14* (2013.01); *E05B 2067/386* (2013.01); *Y10S 70/43* (2013.01); *Y10S 70/56* (2013.01); *Y10S 292/32* (2013.01); *Y10T 70/493* (2015.04); *Y10T 70/498* (2015.04)

(58) Field of Classification Search
CPC ..... E05B 73/00; E05B 67/38; E05B 83/14; E05B 2067/386; E05B 67/383; Y10T 70/493; Y10T 70/496; Y10T 70/498; Y10S 70/43; Y10S 70/56; Y10S 292/32
USPC ..... 70/202, 203, 211, 212, 54–56, 417,70/DIG. 43, DIG. 56, 95–100; 292/205, 207, 292/208, 211, 218, DIG. 32
See application file for complete search history.

(56) References Cited

U.S. PATENT DOCUMENTS

| | | | | | |
|---|---|---|---|---|---|
| 3,125,873 | A * | 3/1964 | Robinson | E05B 29/002 | 206/1.5 |
| 3,151,898 | A * | 10/1964 | Olander | E05B 83/10 | 292/1 |
| 3,563,069 | A * | 2/1971 | Ferrer | E05B 13/001 | 292/150 |
| 4,033,156 | A * | 7/1977 | Cottingham | E05B 17/002 | 174/67 |
| 4,313,321 | A * | 2/1982 | Wasser | B60K 15/05 | 220/210 |
| 4,573,332 | A * | 3/1986 | Ma | A45C 13/20 | 109/52 |
| 4,845,966 | A * | 7/1989 | Perry | B60J 7/106 | 296/224 |
| 4,884,424 | A * | 12/1989 | Meyer | E05B 17/142 | 70/160 |
| 4,926,662 | A * | 5/1990 | Gaudet | E05B 17/002 | 70/159 |
| 5,118,149 | A * | 6/1992 | Emmons | E05B 13/002 | 292/205 |
| 5,275,028 | A * | 1/1994 | Giarrante | E05B 17/002 | 70/455 |

(Continued)

*Primary Examiner* — Lloyd Gall
(74) *Attorney, Agent, or Firm* — Epstein Drangel LLP; Robert L. Epstein

(57) ABSTRACT

The protector includes a box-like metal housing formed of first and second housing parts connected by a spring-loaded hinge for movement between an open position, in which a seal associated with the vehicle cargo compartment door handle is exposed, and a closed position, in which the seal cannot be accessed. At least one of the housing parts is hollow and configured to accommodate the handle such that when the housing parts are in the closed position the seal is fully enclosed. A padlock may be used to lock the housing parts in the closed position such that the seal cannot be accidentally broken falsely indicating that the cargo compartment door has been opened during transit.

11 Claims, 8 Drawing Sheets

(56) References Cited

U.S. PATENT DOCUMENTS

| | | | | | |
|---|---|---|---|---|---|
| 5,462,015 | A * | 10/1995 | Murphy | A01K 1/0245 | 119/165 |
| 5,737,946 | A * | 4/1998 | Sole | E05B 13/001 | 292/104 |
| 5,775,747 | A * | 7/1998 | Navarsky | E05B 13/002 | 292/307 B |
| 6,047,573 | A * | 4/2000 | Martinez | E05B 67/383 | 220/367.1 |
| 7,278,284 | B1 * | 10/2007 | James | E05B 13/002 | 292/205 |
| 7,874,188 | B2 * | 1/2011 | Chudzicki | E05B 13/002 | 292/DIG. 32 |
| 7,878,032 | B1 * | 2/2011 | Gogel | E05B 67/38 | 292/205 |
| 8,596,100 | B1 * | 12/2013 | Crispell | E05B 65/0021 | 292/DIG. 32 |
| 9,032,765 | B2 * | 5/2015 | Boesel | E05B 13/002 | 292/285 |
| 2005/0126235 | A1 * | 6/2005 | Melchiori | E05B 13/002 | 70/210 |
| 2012/0210754 | A1 * | 8/2012 | Thomsen | E05B 13/002 | 70/14 |

* cited by examiner

CARGO DOOR SEAL PROTECTOR

CROSS-REFERENCE TO RELATED APPLICATIONS

Priority is claimed on Provisional Patent Application No. 62/356,279, filed Jun. 29, 2016, the contents of which are incorporated herein by reference.

STATEMENT REGARDING FEDERALLY SPONSORED RESEARCH OR DEVELOPMENT

Not Applicable

REFERENCE TO A "SEQUENCE LISTING", A TABLE, OR A COMPUTER PROGRAM LISTING APPENDIX SUBMITTED ON COMPACT DISC

Not Applicable

BACKGROUND OF THE INVENTION

1. Field of the Invention

The present invention relates to a security device for protecting cargo in the cargo compartment of a vehicle during transport and more particularly to a device designed to prevent a seal associated with the handle of the cargo compartment door from being accidentally broken, falsely indicating unauthorized access to the cargo compartment.

2. Description of Prior Art Including Information Disclosed Under 37 CFR 1.97 and 1.98

Vehicles of various types, such as trucks, trailers, aircraft, ships and the like commonly transport cargo from one destination to another. The vehicles are provided with cargo compartments within which the cargo is situated. The cargo compartment is accessed through a door which can be locked to prevent unauthorized access to the cargo compartment, preventing the cargo from being damaged or stolen.

The cargo compartment doors can be of the side mounted swing-out type or the roll-up type. Both types of doors are provided with factory installed handles which can be moved between a position in which the cargo compartment door can be opened and a position in which the cargo compartment door cannot be opened. A lock is associated with the handle which prevents the handle from being moved to the position where the door can be opened, thereby preventing access to the cargo compartment.

In order to assure that the cargo compartment has not been accessed during transit, a seal is installed on the handle of the cargo compartment door after the cargo is loaded, the door is closed and the handle is moved to the position where the door cannot be opened. Once the seal is installed, the handle cannot be moved and thus the door cannot be opened without breaking the seal.

Many seals used for this purpose are made of plastic and very easily broken. Other seals such as bolt seals are made of metal and typically require tools to break. Regardless of the type, these seals are not intended to protect the cargo by preventing access to the cargo compartment. The seals are used as proof that the cargo door has not been opened during transit.

If the vehicle arrives at its destination with the seal intact, that indicates that the cargo compartment has not been accessed and the cargo can be accepted. On the other hand, if the vehicle arrives with the seal broken, that indicates that the handle has moved and that the cargo may have been tampered with or stolen, and should not be accepted.

Accordingly, it is important to the shipper, to those responsible for the vehicle during transit, and to the receiver of the cargo, that the seal accurately reflect whether the cargo compartment has been accessed during transit or not.

Often the driver of the vehicle or the delivery company is merely transporting the vehicle with the cargo and does not own the vehicle or the seal. However, they may be financially responsible for the cargo if the seal is broken and the load is refused at the delivery point.

Accordingly, there is a need for a device which can protect the seal during transit so that it is not accidentally broken.

It is therefore a prime object of the present invention to provide a protector for a seal mounted on the handle of a vehicle cargo compartment door.

It is another object of the present invention to provide a protector for the seal on the handle of a vehicle cargo compartment door which can fully enclose the seal during transit so that the seal is not accidentally broken.

It is another object of the present invention to provide a protector which can be used for the seal on the handle of a vehicle cargo compartment door regardless of the type of seal used or material from which the seal is made.

It is another object of the present invention to provide a protector for the seal on the handle of a vehicle cargo compartment door which is suitable for use with doors of the side mounted swing-out type.

It is another object of the present invention to provide a protector for the seal on the handle of a vehicle cargo compartment door which is suitable for use with doors of the roll-up type.

It is another object of the present invention to provide a protector for the seal on the handle of a vehicle cargo compartment door which can be easily installed on the door.

It is another object of the present invention to provide a protector for the seal on the handle of a vehicle cargo compartment door which can be locked to prevent access to the seal.

It is another object of the present invention to provide a protector for the seal on the handle of a vehicle cargo compartment door which can be locked by a padlock.

It is another object of the present invention to provide a protector for the seal on the handle of a vehicle cargo compartment door formed of hollow metal housing parts connected by a spring-loaded hinge.

It is another object of the present invention to provide a protector for the seal on the handle of a vehicle cargo compartment door which encloses the portion of the handle upon which the seal is mounted.

BRIEF SUMMARY OF THE INVENTION

The purpose of the seal protector of the present invention is to guard the integrity of the plastic or metal bolt seal on cargo vehicles. The seal protector is a metal housing formed of two hollow housing parts which when closed fully encloses the portion of the seal and the portion of the door handle where the seal is situated such that the seal is isolated and cannot be accidentally broken.

In one preferred embodiment, the protector is portable and may be mounted on the vehicle after the seal is installed. In another preferred embodiment, the seal protector is permanently affixed to the surface of the cargo door. In either case, the protector can be used repeatedly.

A padlock or the like may be used to keep the parts of the housing closed. At the destination point, the housing is unlocked and the seal can be examined without affecting the seal.

The protector for the seal is associated with the handle of the door of a vehicle cargo compartment. The handle is moveable between a first position, in which the cargo compartment door can be opened to access the cargo compartment, and a second position, in which the cargo door cannot be opened. The seal would be broken if the handle were moved from its second position.

The housing parts are connected by a hinge so they can be moved between an open position, in which the seal is exposed, and a closed position, in which the seal is enclosed and cannot be accessed. At least one of the housing parts is configured to accommodate the handle such that when the housing parts are in the closed position the seal can be fully enclosed. The padlock locks the housing parts in the closed position.

The housing includes a base part and a cover part. The base part is situated adjacent the surface of the door, at a location under the handle. The door has hardware for mounting the seal. The base part has a recess adapted to accommodate the seal mounting hardware of the door, such that the protector can be situated in the appropriate position on the door.

The base part includes a generally planar portion. A member with an opening extends from the edge of the base part which is remote from the hinge which connects the housing parts. The cover part also has a member with an opening. The opening in the base part member and the opening in the cover part member align when the housing parts are in the closed position. The padlock shackle can be received in the aligned member openings to lock the housing parts in the closed position.

The cover part includes first and second sides. Each of the sides has an opening adapted to receive the handle when the housing parts are in the closed position. In one preferred embodiment, the cover part sides are parallel to each other and the housing parts, when in the closed position, form a box-like enclosure.

In one preferred embodiment, the base part has an open ended recess such that the protector can be removeably mounted on the door partially surrounding the seal mounting hardware. In another preferred embodiment, the base recess completely surrounds the seal mounting hardware such that it is permanently mounted on the door.

In one preferred embodiment, the base part has a loop member mounted on and extending from a recessed portion of the base part surface. The cover part has an opening which aligns with the loop member when the housing parts are in the closed position. The padlock shackle is received through the loop member to lock the housing parts in the closed position.

In one preferred embodiment the cover part has oppositely inclined surfaces. The inclined surfaces form an enclosure with a generally elongated truncated pyramid shape.

The protector is designed for use with cargo compartment doors both of either the side mounted swing-out type and of the roll-up type. It can be used with any type of seal including those made of plastic, such as a cable tie, and those made of metal, such as the bolt type.

BRIEF DESCRIPTION OF THE SEVERAL VIEWS OF DRAWINGS

To these and to such other objects that may hereinafter appear, the present invention relates to a seal protector as described in detail in the following specification and recited in the annexed claims, taken together with the accompanying drawings, in which like numerals refer to like parts and in which:

Figure 9:
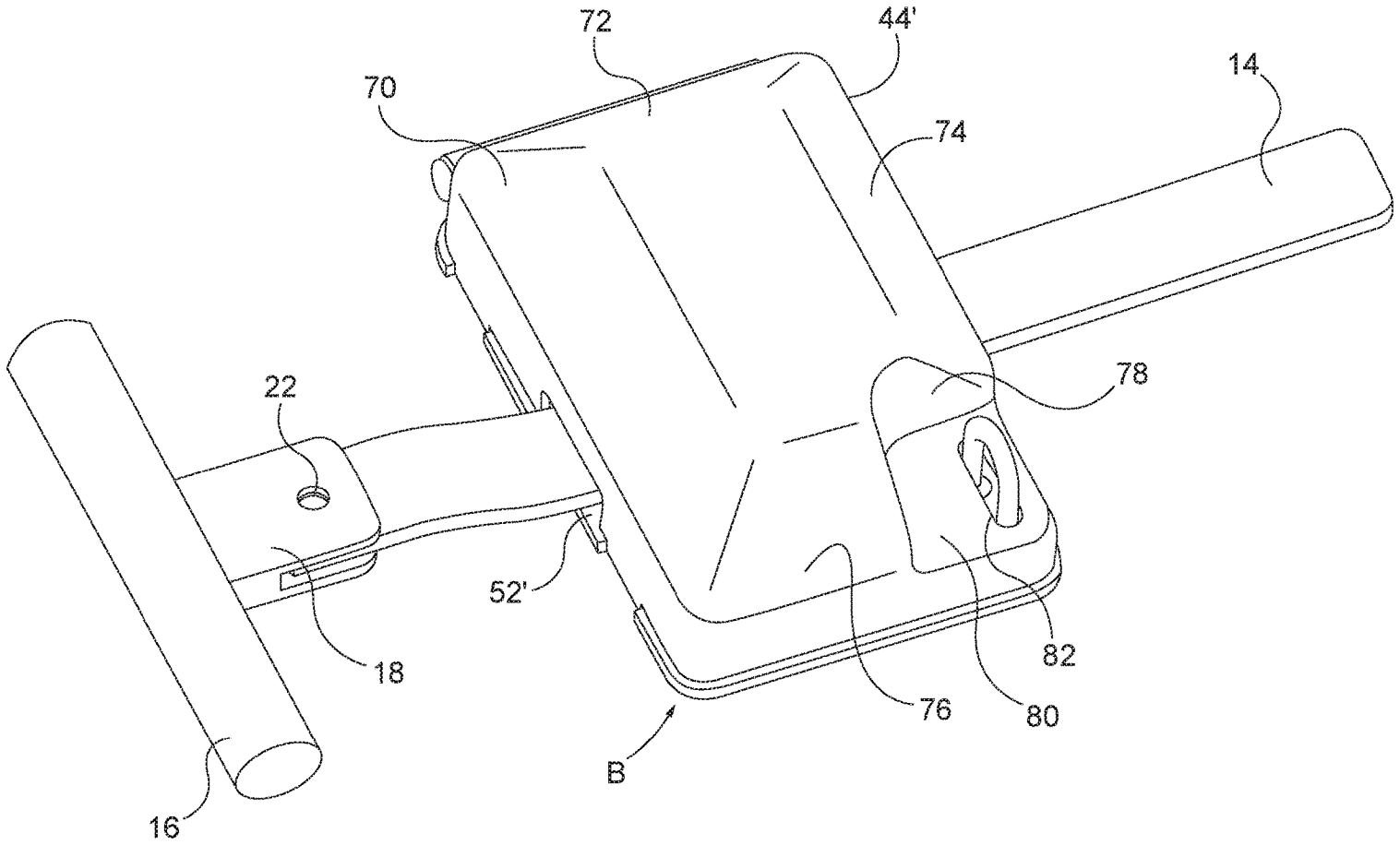
Figure 10:
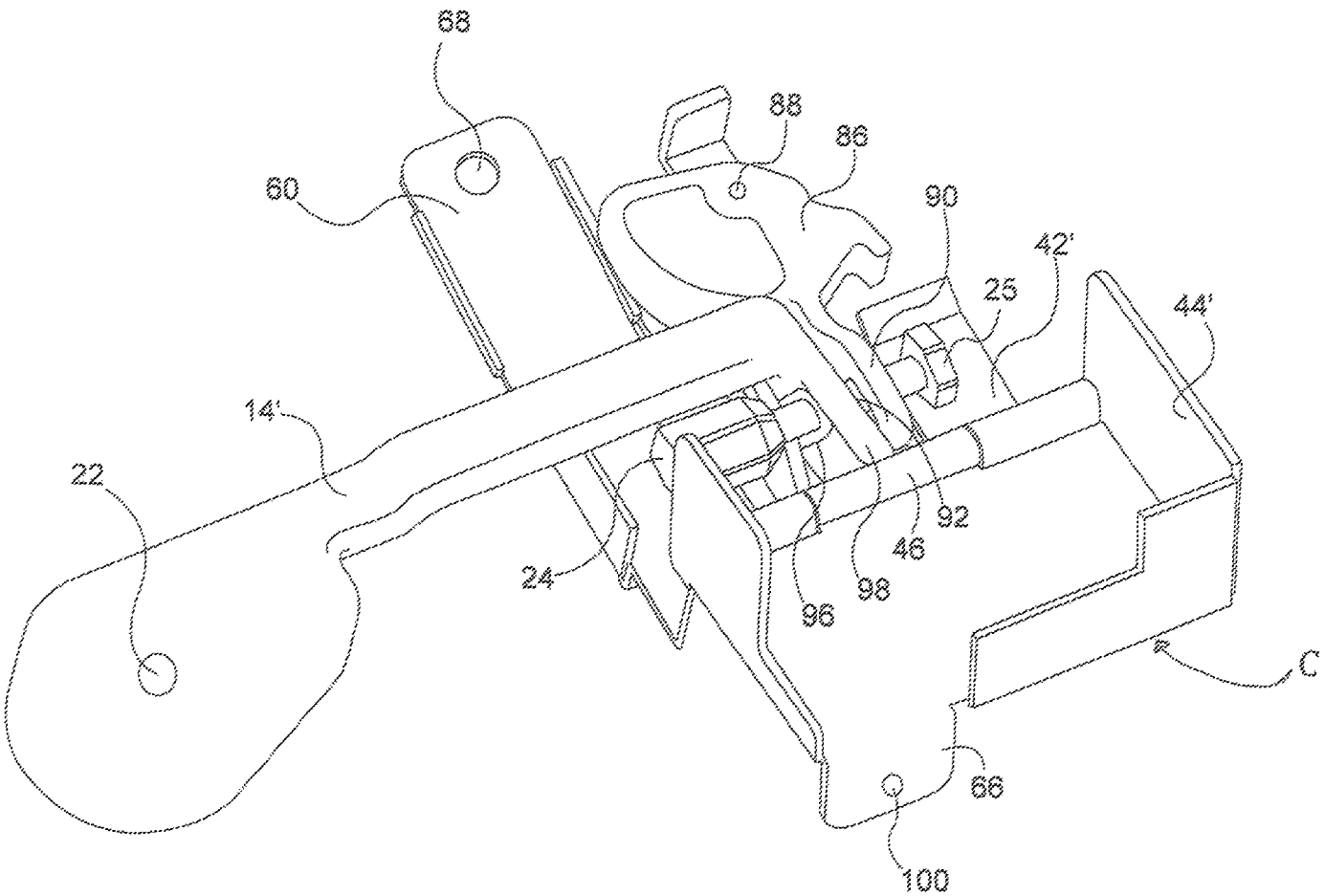

FIG. 9 is a perspective view of the second preferred embodiment of the present invention showing the protector mounted on the handle of a swing-out type door, with the housing parts in the closed position; and FIG. 10 is a perspective view of a third preferred embodiment of the present invention showing the protector mounted on the handle of a roll-up type door, with the housing parts in the open position.

DETAILED DESCRIPTION OF THE INVENTION

Figure 1:
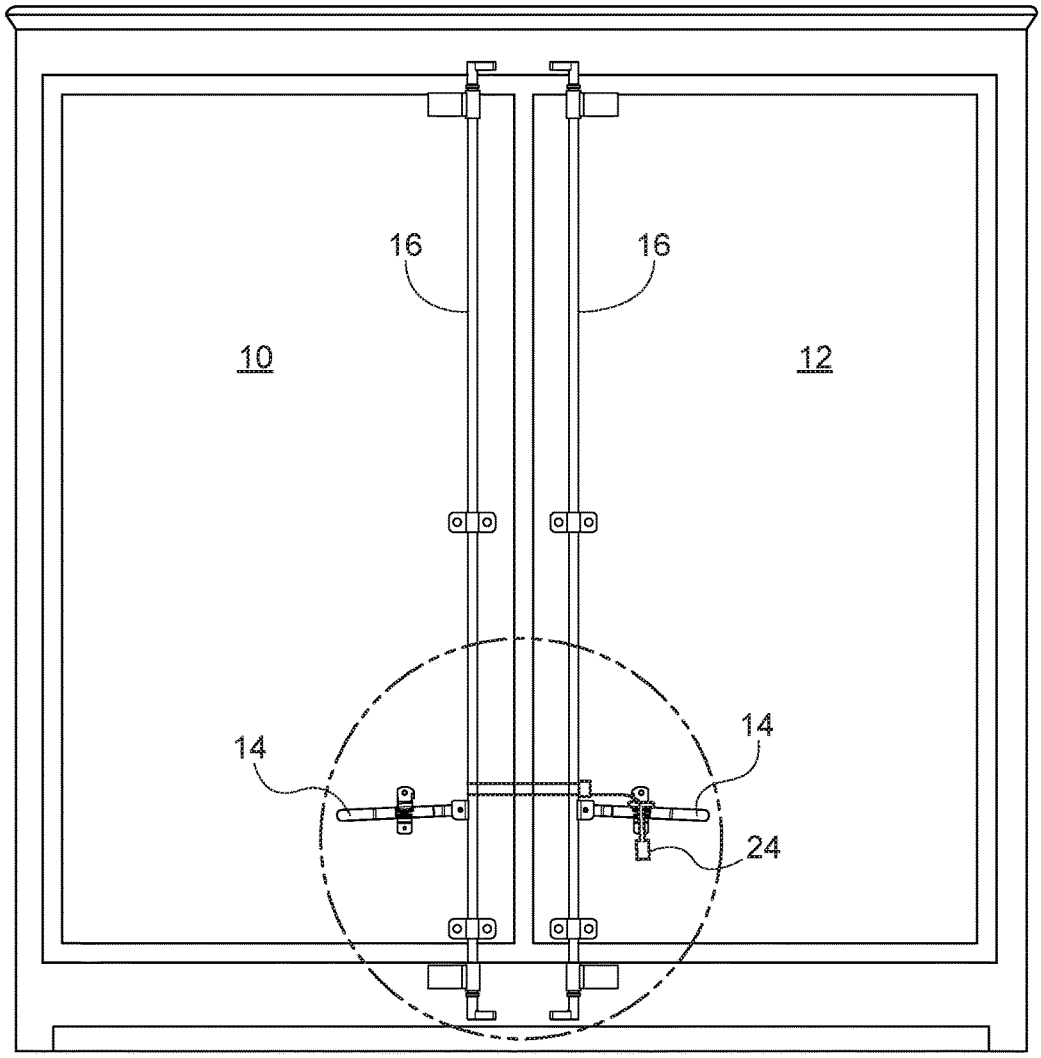
FIG. 1 is an elevation view of the rear portion of a typical trailer having a cargo compartment with first and second side swing-out type access doors in which the right hand door has a bolt seal mounted thereto.

FIG. 1 shows the rear of a vehicle such as a trailer having a cargo compartment accessible through two side mounted swing-out type access doors 10 and 12. Each door has a rotatably mounted handle 14 which controls the latching and unlatching of the door. Each handle is connected to a vertically moveable rod 16 by a pivot bracket 18. The unattached end of the handle can be moved about the vertical axis of the associated rod between a position in which the handle end is adjacent a plate 20 mounted on the surface of the door, and a position remote from the surface of the door. In the latter position, the handle can be pivoted about the axis of the pivot pin 22 of bracket 18 such that rod 16 can be moved relative to the door jamb to latch and unlatch the door.

Figure 2:
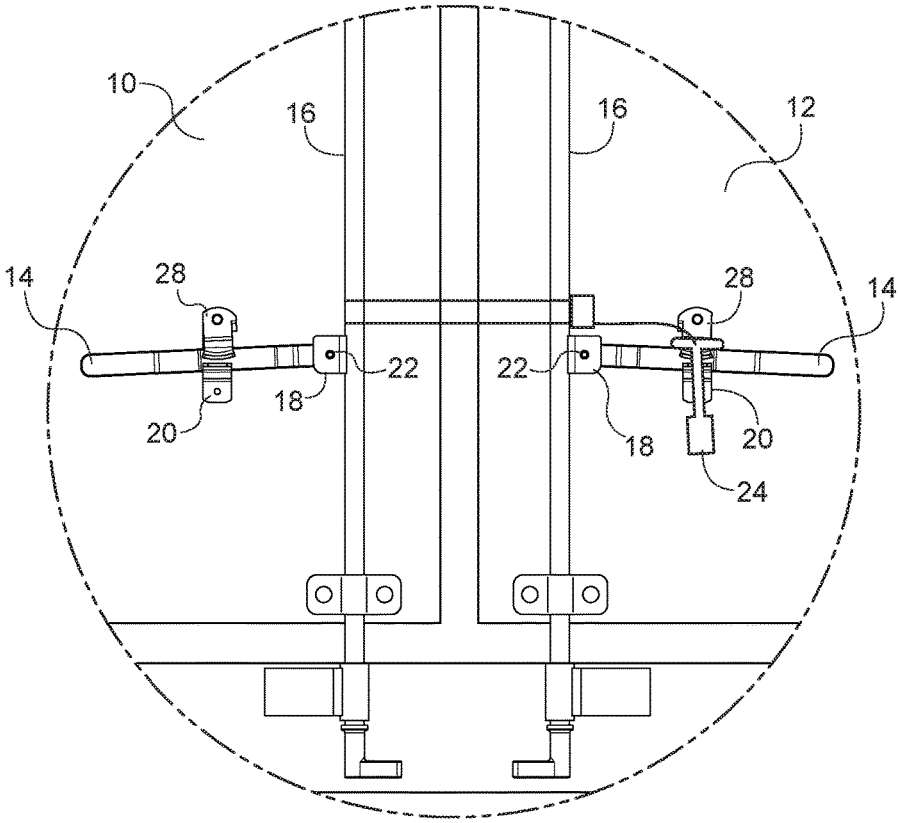
FIG. 2 is an enlarged view of the encircled portion of the doors of FIG. 1.
Figure 3:
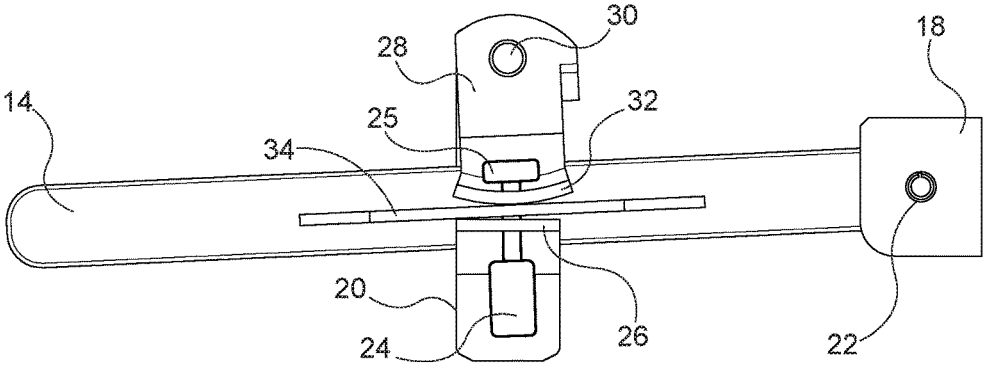
FIG. 3 is a further enlarged view showing a handle, the associated seal mounting hardware on the door and a bolt seal in place on the door.

FIG. 2 shows the handle and seal mounting hardware in greater detail. In particular, it shows that the handle of the right hand door has a metal bolt type seal 24 mounted on it. FIG. 3 shows the mounting hardware and seal in still greater detail.

As seen in FIG. 3, the seal mounting hardware includes plate 20 fixed to the surface of the door by screws or other fasteners (not shown) in openings 30. A part 26 extends outwardly from the surface of the lower portion of plate 20. Part 26 has an opening.

A part 28 is rotationally connected to the surface of the upper portion of plate 20. Part 28 can rotate about the axis of a pin (not shown) situated in an opening 29. Part 28 carries a protruding member 32. Part 28 can be moved to move member 32 between a position out of alignment with part 26 and a position in alignment with part 26. Member 32 also has an opening therein.

This configuration allows part 28 to be rotated to a position out of alignment with part 20 such that handle 14 can be moved to a position adjacent the surface of part 20. Part 28 can then be rotated to a position, shown in FIG. 6, over the upper portion of plate 20, where part 32 is adjacent to part 26 and handle 14 is encircled by members 20 and 28. To facilitate such rotation, part 32 is arcuate, as shown.

In that position, the neck of the seal, in this case a metal bolt type seal 24, can be threaded through the aligned openings in parts 26 and 32 and secured by affixing an end stop 25 on the free end of the seal neck. Once the seal is mounted on the door hardware, the handle cannot be moved from its position without breaking the seal.

As seen in FIG. 3, when a metal bolt type seal 24 is used on a handle with a bend, the handle may be provided with a reinforcing member 34 which extends along the axis of the handle and bridges the bend in the handle. Member 34 will be provided with an opening which aligns with the openings in parts 26 and 32 such that the neck of the seal can pass through member 34.

Figure 4:
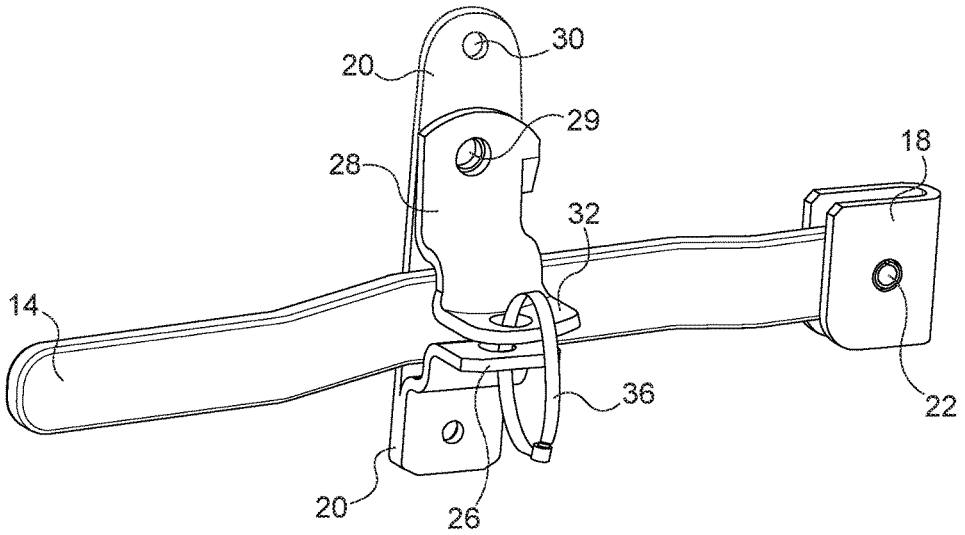
FIG. 4 is a perspective view of the handle and seal mounting hardware with a plastic seal mounted thereon.
Figure 5:
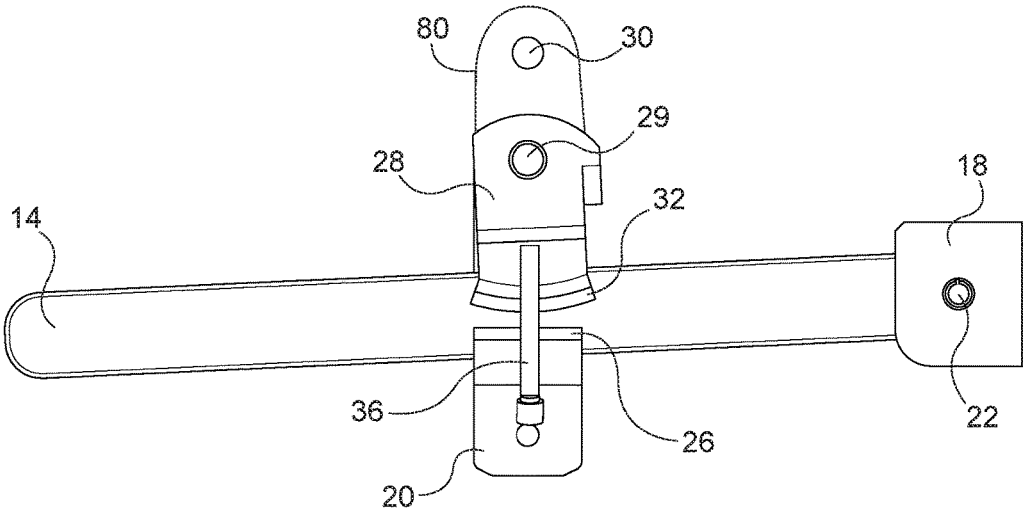
FIG. 5 is an elevation view of the handle, seal mounting hardware and seal of FIG. 4.

FIGS. 4 and 5 show the handle and mounting hardware as it would appear with a plastic seal 36. In this case, plastic seal 36 takes the form of a conventional cable tie.

Figure 6:
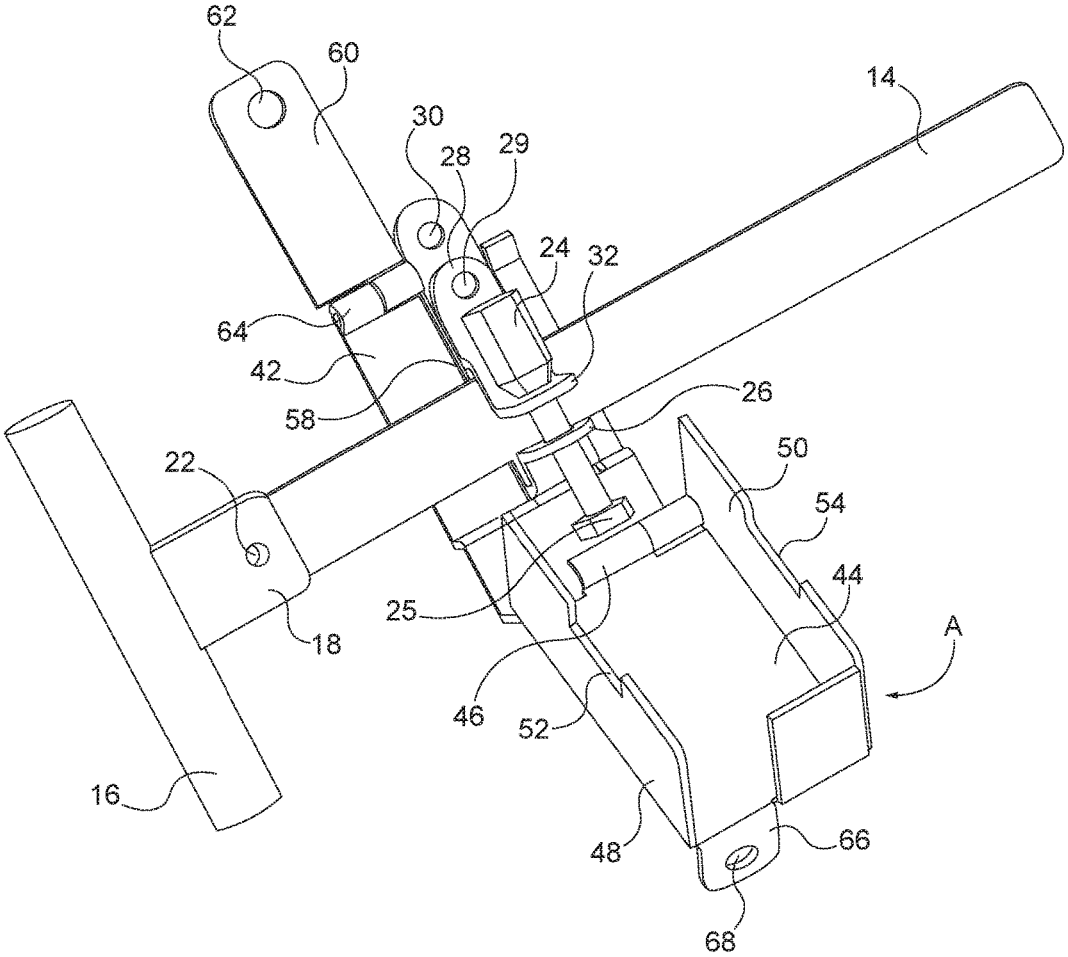
FIG. 6 is perspective view of the first preferred embodiment of the present invention showing the protector situated on a side mounted swing-out type door with a bolt seal in place, before the housing parts are closed.
Figure 7:
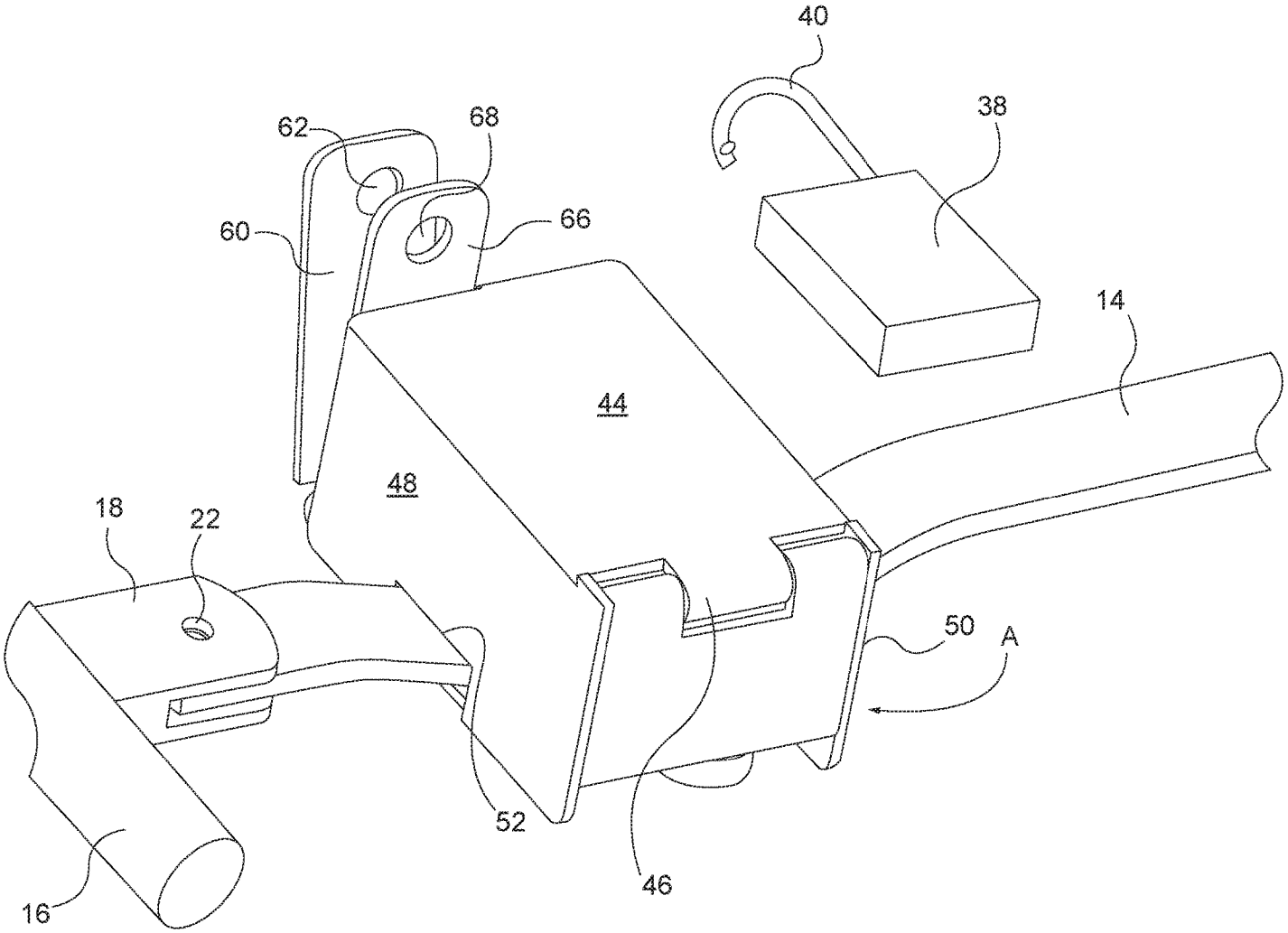
FIG. 7 is perspective view of the first preferred embodiment of the present invention showing the protector mounted on a side mounted swing-out type door, with the housing parts in the closed position.

FIGS. 6 and 7 show the first preferred embodiment of the seal protector of the present invention which is designed to guard the integrity of a plastic or metal bolt seal mounted on the side mounted swing-out type door of the cargo compartment of a vehicle. As seen in these figures, the seal protector is a strong metal housing, generally designated A, formed of two hollow housing parts which when closed fully enclose the seal 24 and the portion of the door handle 14 where the seal 24 is situated.

Seal protector A is designed to be removeably mounted on the vehicle door before or after the seal 24 is installed. A padlock 38 with a shackle 40 or the like may be used to lock the housing parts in the closed position. At the destination point, the housing is unlocked and the seal may be examined to determine if the seal is broken.

The housing parts include a base part 42 and a cover part 44. The housing parts are connected by a strong spring-loaded hinge 46 which is covered and protected from attack. The hinge allows the housing parts to move between an open position as seen in FIG. 6, in which the seal is exposed, and a closed position as seen in FIG. 7, in which the seal cannot be accessed.

The spring in the hinge urges the housing parts toward the open position. Accordingly, when the housing is removed from the door the housing parts will automatically open to expose the seal so it can easily be examined.

At least one of the housing parts, in this case cover part 44, includes opposite side walls 48, 50 having aligned recesses 52, 54. The recesses are designed to accommodate the handle such that when the housing parts are in the closed position, the seal is fully enclosed.

Base part 42 is generally planar and is formed with an open ended recess 58 such that it can accommodate the plate 20. This structure allows protector A to be mounted on and removed from the vehicle door surface when the housing parts are in the open position.

A member 60 with an opening 62 is connected to the unattached edge of base part 42 (the edge which is remote from hinge 46) by a strong protected hinge 64. Thus, member 60 can rotate relative to base part 42. Member 60 has an opening 62.

A member 66 is fixedly attached to the cover part 44. Member 66 has an opening 68. When the housing parts are in the closed position, as seen in FIG. 7, members 60 and 66 are adjacent to each other and the openings 62 and 68 in those members are aligned. In that position, the shackle 40 of a padlock 38 can be received through aligned openings 62 and 68, locking the housing parts in the closed position.

In this preferred embodiment, the sides of housing A are parallel to each other. Thus, the housing parts, when in the closed position, form a box-like enclosure.

Figure 8:
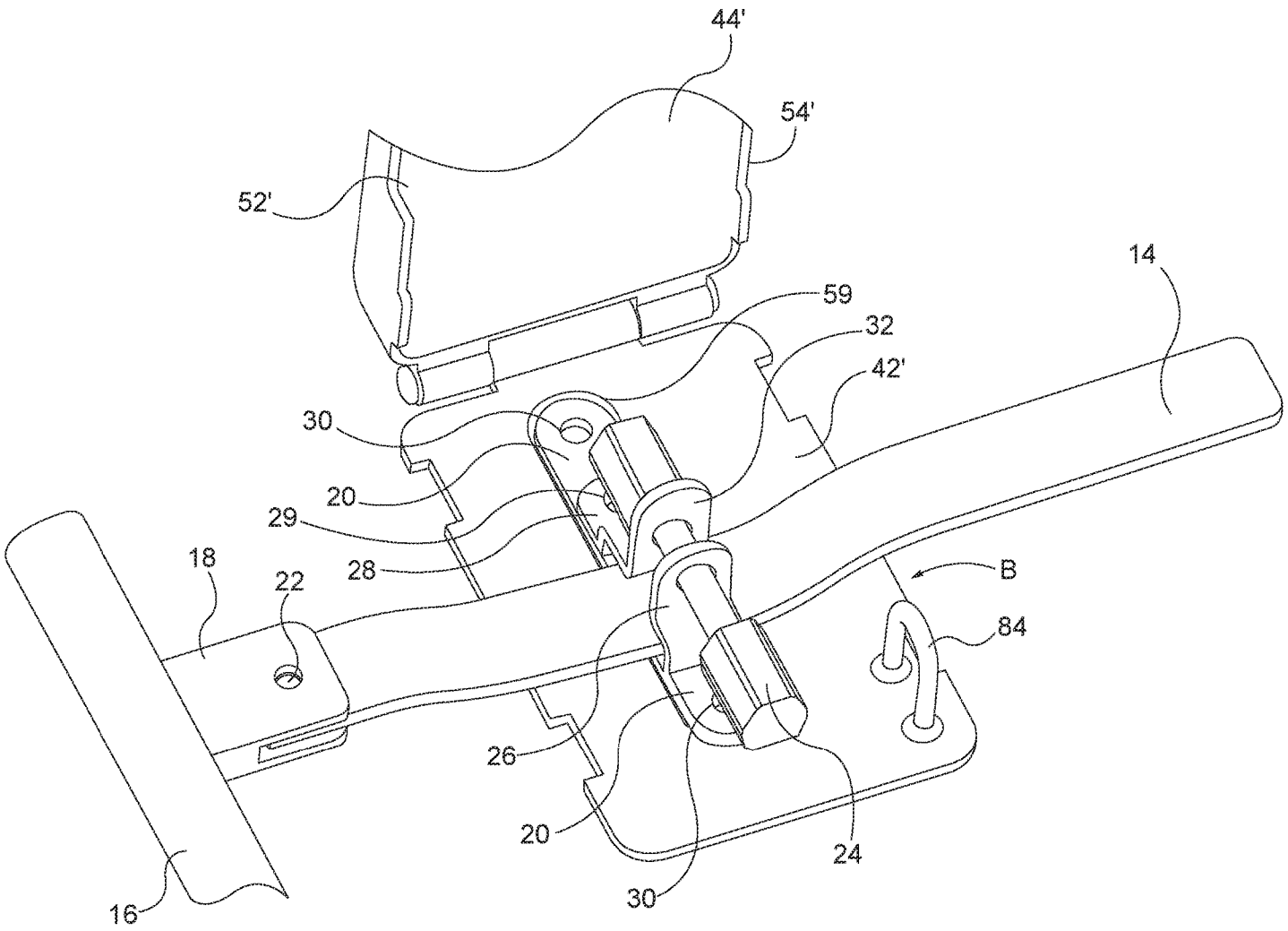
FIG. 8 is a perspective view of a second preferred embodiment of the present invention showing the protector mounted on a swing-out type door, with the housing parts in the open position.

A second preferred embodiment of the present invention, as seen in FIGS. 8 and 9, is also designed from use on a side mounted swing-type door. The second preferred embodiment includes a housing, generally designated B, which functions in a manner similar housing A of the first preferred embodiment but is designed to be permanently fixed to the door surface.

In this embodiment, the open ended recess of base part 42' is replaced with an oval cut-out 59 sized and shaped to accommodate the seal mounting plate 20. The base part 42' is situated adjacent the surface of the vehicle door, completely surrounding plate 20 of the seal mounting hardware.

In this second preferred embodiment, the shape of the cover part 44' is that of an elongated, truncated pyramid. The cover part has with outwardly inclined sides 70, 72, 74 and 76. Sides 70 and 74 are oppositely inclined. Sides 72 and 76 are oppositely inclined. Recesses 52' and 54' are provided in the cover part to accommodate the handle.

The lower right hand corner of cover part 44' has a recess 78 with a flat section 80 having an elongated opening 82. The lower right hand section of base part 42' has a loop member 84 mounted thereon. When cover part 44' is closed over base part 42', loop member 84 extends through opening 82 in the cover part such that the shackle 40 of a padlock 38 can be received therein to lock the housing parts in the closed position.

FIG. 10 illustrates a third preferred embodiment of the present invention which is designed for use with roll-up type cargo doors. Roll-up cargo doors have a rotatable handle 14' which causes a "J hook" type latch (not shown) to engage a part in the door jamb to prevent the door from being opened.

The door also has rotatable locking member 86 which rotates about the axis of a pin 88. The axis of pin 88 is perpendicular to the surface of the vehicle door and is parallel to the axis about the pin adapted to be received in opening 22 about which the handle 14' rotates.

Member 86 has a tail 90 with an opening 92 which aligns with the opening 96 in end 98 of handle 14' when the handle is in the closed position, as seen in the FIG. 10. When the handle and locking member are in the position illustrated in FIG. 10, the seal 24 can be threaded through aligned openings 92 and 96. Rotation of handle 14' from that position will break seal 24, indicating that the door may have been opened.

The third preferred embodiment is similar in structure to the first preferred embodiment in that the housing, generally designated C, has a rectangular shaped cover part 44' which is connected to a generally planar base part 42' by a hinge 46. Thus, when the cover part is in the closed position, the opening 68 in member 60 aligns with the opening 100 in member 66 and the shackle of a padlock can be inserted through the aligned openings to lock the housing parts in the closed position.

The main difference is that, in the third preferred embodiment, housing C is elongated in the lateral direction to accommodate the horizontally extending seal 24. However, the function of the third preferred embodiment of the protector is essentially the same as that of the first and second preferred embodiments.

While only a limited number of preferred embodiments of the present invention have been disclosed for purposes of illustration, it is obvious that many modifications and variations could be made thereto. It is intended to cover all of those modifications and variations which fall within the scope of the present invention, as defined by the following claims.

I claim:

1. A protector for the seal associated with the handle of the door of a vehicle cargo compartment of the type having a handle moveable between a first position, wherein the cargo compartment door can be opened to access the cargo compartment, and a second position, wherein the cargo door cannot be opened, wherein the seal would be broken if the handle were moved from its second position, the protector comprising a metal housing, said housing comprising a base part adapted to be inserted between the cargo compartment door and the handle and a cover part comprising a front wall, first and second side walls each having a recess to accommodate the handle, a first end wall comprising a first locking member extending beyond the plane of said front wall and having an opening therein and a second end wall, said second end wall being pivotally connected to said front wall and pivotally connected to said base part such that said cover part can be moved relative to said base part between an open position, wherein the seal is exposed, and a closed position, wherein said seal cannot be accused, further comprising a second locking member pivotally connected to said base part and having an opening therein, such that when said cover part is in said closed position said opening in said first locking member and said opening in said second locking member are aligned.

2. The protector of claim 1 wherein said base part comprises a generally planar portion.

3. The protector of claim 1 further comprising a padlock with a shackle, wherein said padlock shackle may be received in said aligned openings of said first and second locking members to lock said housing parts in said closed position.

4. The protector of claim 1 adapted for use with a cargo compartment door of the side mounted swing type.

5. The protector of claim 1 adapted for use with a bolt type seal.

6. The protector of claim 1 adapted for use with a plastic seal.

7. The protector of claim 1 adapted for use with a cable tie type seal.

8. The protector of claim 1 wherein said base part comprises a recess open on one side.

9. The protector of claim 8 wherein said base part recess is adapted to receive the seal mounting hardware.

10. The protector of claim 1 wherein said second end wall is pivotally connected to said front wall at one end and pivotally connected to said base part at the other end.

11. The protector of claim 1 wherein said base part is pivotally connected to said second end wall at one end and pivotally connected to said second locking member at the other end.

* * * * *